US011846009B2

(12) United States Patent
Nagase et al.

(10) Patent No.: US 11,846,009 B2
(45) Date of Patent: Dec. 19, 2023

(54) HARD PARTICLE POWDER FOR SINTERED BODY

(71) Applicants: DAIDO STEEL CO., LTD., Nagoya (JP); NIPPON PISTON RING CO., LTD., Saitama (JP)

(72) Inventors: Iwane Nagase, Nagoya (JP); Fumito Mizuno, Nagoya (JP); Yuji Nagaoka, Tochigi (JP); Satoshi Ikemi, Tochigi (JP); Katsuaki Sato, Tochigi (JP)

(73) Assignees: DAIDO STEEL CO., LTD., Nagoya (JP); NIPPON PISTON RING CO., LTD., Saitama (JP)

( * ) Notice: Subject to any disclaimer, the term of this patent is extended or adjusted under 35 U.S.C. 154(b) by 0 days.

(21) Appl. No.: 17/865,987

(22) Filed: Jul. 15, 2022

(65) Prior Publication Data

US 2023/0038356 A1 Feb. 9, 2023

(30) Foreign Application Priority Data

Jul. 20, 2021 (JP) ..... 2021-119670

(51) Int. Cl.

| | |
|---|---|
| ***C22C 38/44*** | (2006.01) |
| ***C22C 38/02*** | (2006.01) |
| ***B22F 3/10*** | (2006.01) |
| ***B22F 1/052*** | (2022.01) |
| *C22C 30/00* | (2006.01) |

(52) U.S. Cl.

CPC ..... *C22C 38/44* (2013.01); *B22F 1/052* (2022.01); *B22F 3/10* (2013.01); *C22C 38/02* (2013.01); *C22C 30/00* (2013.01)

(58) Field of Classification Search

None

See application file for complete search history.

(56) References Cited

U.S. PATENT DOCUMENTS

| | | | |
|---|---|---|---|
| 2001/0018852 A1 | 9/2001 | Ando et al. | |
| 2006/0219054 A1 | 10/2006 | Kawata et al. | |
| 2007/0081914 A1 | 4/2007 | Yoshihiro et al. | |
| 2017/0089228 A1 | 3/2017 | Shimada et al. | |
| 2018/0149280 A1 | 5/2018 | Takaki et al. | |
| 2019/0256955 A1* | 8/2019 | Nagase | C22C 30/00 |

FOREIGN PATENT DOCUMENTS

| | | |
|---|---|---|
| CN | 101260496 A | 9/2008 |
| JP | 2003-193173 A | 7/2003 |
| JP | 2006-274359 A | 10/2006 |
| JP | 2007-107034 A | 4/2007 |
| WO | WO 2015/141331 A1 | 9/2015 |

OTHER PUBLICATIONS

Chinese Office Action dated Jul. 12, 2023, in corresponding Chinese Patent Application No. 202210857089.8, with an English translation thereof.

* cited by examiner

*Primary Examiner* — Anthony M Liang

(74) *Attorney, Agent, or Firm* — MCGINN I.P. LAW GROUP, PLLC

(57) ABSTRACT

The present invention relates to a hard particle powder for a sintered body, the powder including, in terms of mass %, 0.01≤C≤1.0, 2.5≤Si≤3.3, 0.1≤Ni≤20.0, 5.0≤Cr≤15.0, and 35.0≤Mo≤45.0, with the balance being Fe and inevitable impurities, in which the powder before performing sintering comprises an alloy phase comprising a hexagonal crystal structure of C14 type Laves phase.

4 Claims, 12 Drawing Sheets

HARD PARTICLE POWDER FOR SINTERED BODY

TECHNICAL FIELD

The present invention relates to a hard particle powder for a sintered body. More particularly, the present invention relates to a hard particle powder for sintered bodies which, when used to produce sintered bodies (e.g., valve seats for car engines), attains high wear resistance.

BACKGROUND ART

MONICR7 is well known as a Co-based hard particle that have a high wear resistance and form a hard phase mainly including a Mo silicide. A Co-2Si-10Ni-25Cr-25Mo alloy powder, which is equivalent material of MONICR7, is frequently used as hard particles greatly contributing to the wear resistance of valve seats for car engines (hereinafter referred to simply as "valve seats") in car engines used under high load. A large number of background-art techniques have hence been proposed.

For example, Patent Document 1 discloses a method for manufacturing a wear-resistant sintered member, aiming to disperse a larger amount of a hard phase in a base without impairing wear resistance, strength, or the like. The method includes compression-molding a raw material powder including a base-forming powder (iron, SUS316, SUS304, SUS310, or SUS430) and a hard-phase-forming powder (Co-28Mo-2.5Si-8Cr), and then performing sintering, in which 90 mass % or more of the base-forming powder is a fine powder having a maximum particle diameter of 46 μm and the proportion of the hard-phase-forming powder to the raw material powder is from 40 mass % to 70 mass %.

In addition, Patent Document 2 discloses a method for manufacturing a wear-resistant iron-based alloy material for a valve seat, aiming to obtain an iron-based sintered alloy material having excellent wear resistance. The method includes: compression-molding an iron-based alloy powder obtained by adding from 0.2 to 3.0 parts by weight of a solid lubricant powder (sulfide or fluoride) and/or from 0.2 to 5.0 parts by weight of an oxide-stabilized powder ($Y_2O_3$, $CeO_2$, or $CaTiO_3$, which is an oxide of a rare earth element) to 100 parts by weight of an iron-based alloy powder including a pure iron powder, an iron alloy powder, a carbon powder, a fine carbide-precipitated steel powder, and a hard particle powder (Cr—Mo—Co-based powder, Ni—Cr—Mo—Co-based powder, etc.); and then performing sintering, thereby obtaining a sintered body.

Patent Document 1: JP-A-2007-107034

Patent Document 2: JP-A-2003-193173

Nowadays, the wear resistance required of valve seat materials is further increasing with increases in load to be imposed on engines. The hard particle powders disclosed in Patent Documents 1 and 2, although excellent in terms of the wear resistance required of valve seat materials, contain Co in large amounts. With respect to Co, the cost of resources is rising steeply because of the rapidly increasing demand for lithium ion batteries due to the recent worldwide increase in the number of electric vehicles, and it has become more difficult to acquire the raw materials. In the case where a valve seat material is made to have a reduced Co concentration, there is a possibility that the required wear resistance, powder characteristic, and sintering characteristics might be impaired. There has hence been a desire for developing a hard particle powder for sintered bodies which has a low-cost alloy composition satisfactory in terms of the availability of raw materials and which can attain the wear resistance required of valve seat materials.

An object of the present invention is to provide, under such circumstances, a hard particle powder for sintered bodies which has an alloy powder composition containing no Co and which can give sintered bodies having improved wear resistance, while retaining powder characteristics and sintering characteristics.

SUMMARY OF INVENTION

The present inventors made various investigations in order to overcome the above-mentioned problem and, as a result, have found that an alloy powder in which the areal proportion of an Mo—Si hard phase (face-centered cubic crystal structure of C15 type Laves phase) after performing sintering has been increased to from 60 to 85% from that in conventional Co-based alloy powders, which is about 30%, can give sintered bodies having high hardness and excellent wear resistance, even when the alloy powder is an Fe-based alloy powder which is prone to bring about low hardness and low wear resistance.

In order to solve the above-mentioned problems, a hard particle powder for a sintered body of the present invention relates to the following configurations (1) to (3):

(1) A hard particle powder for a sintered body, the powder including, in terms of mass %, $0.01 \leq C \leq 1.0$, $2.5 \leq Si \leq 3.3$, $0.1 \leq Ni \leq 20.0$, $5.0 \leq Cr \leq 15.0$, and $35.0 \leq Mo \leq 45.0$, with the balance being Fe and inevitable impurities, in which the powder before performing sintering includes an alloy phase including a hexagonal crystal structure of C14 type Laves phase.

(2) The hard particle powder for a sintered body according to (1), in which in the powder, an average circularity of particles having a particle size in a range of D50±5 μm is from 0.6 to 1.0.

(3) The hard particle powder for a sintered body according to (1) or (2), in which in the powder after performing sintering, an areal proportion of a Mo—Si hard phase having a face-centered cubic crystal structure of C15 type Laves phase is from 60 to 85% to a total sectional area of the hard particle powder after performing sintering.

The present invention can provide a hard particle powder for sintered bodies which has an alloy powder composition containing no Co and which can give sintered bodies having improved wear resistance, while retaining powder characteristics and sintering characteristics.

DESCRIPTION OF EMBODIMENTS

Figure 1:
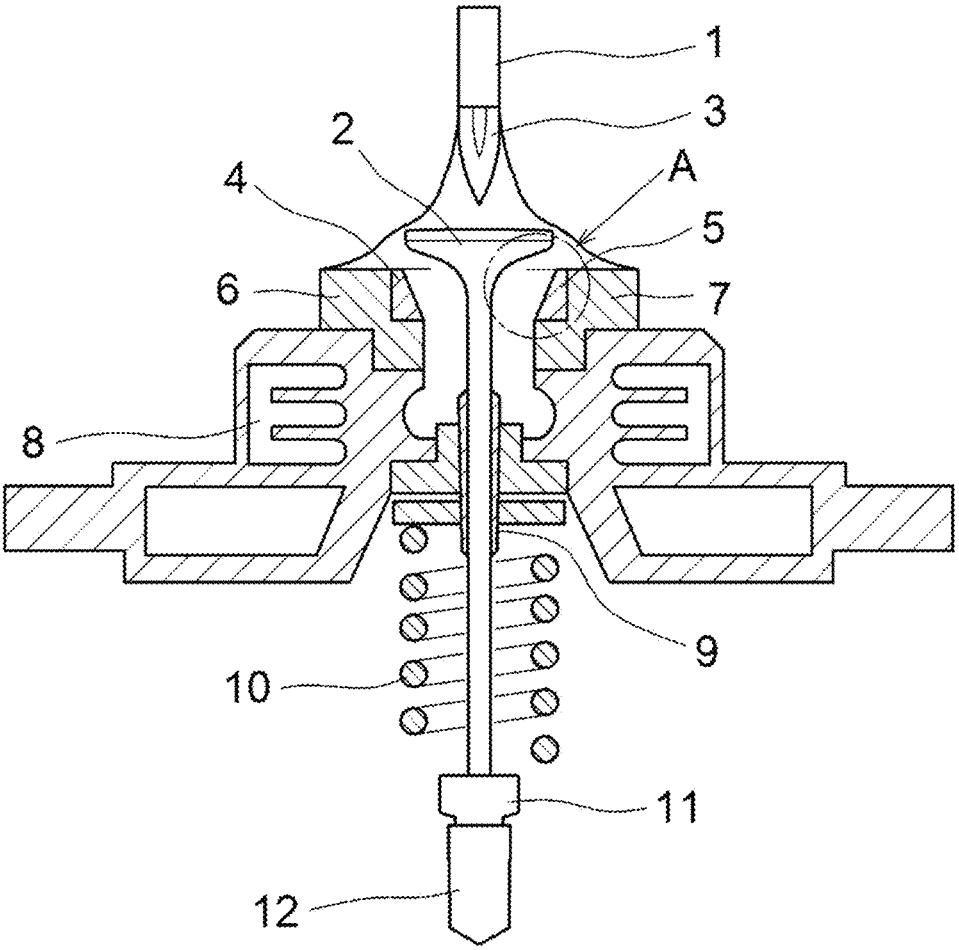
FIG. 1 is a cross-sectional view illustrating an outline of a single rig wear testing machine.

Hereinafter, a hard particle powder for a sintered body (hereinafter sometimes referred to simply as "hard particle powder") according to one embodiment of the present invention and a sintered body obtained using the hard particle powder will be described in detail.

1. Hard Particle Powder for Sintered Body

The hard particle powder according to the present embodiment includes C, Si, Ni, Cr, and Mo, with the balance being Fe and inevitable impurities.

(Reasons for Limiting Chemical Components, Etc.)

Reasons for limiting the chemical components, etc. in the hard particle powder according to the present embodiment are described in detail below. In the following explanations, "%" means "mass %", and content ranges are in terms of mass % unless otherwise indicated.

$0.01 \leq C \leq 1.0$

C is an element which improves the hardness of the particle powder. There are cases where C is supplied, during sintering, from a graphite powder constituting the sintered body. In industrial production, the lower limit of the C content is set at 0.01% in view of the amount of C which can be contained in the raw materials. However, since excessive addition of C leads to a deterioration in toughness due to the formation of carbides, the upper limit of the C content is 1.0%. A preferred range of the C content is $0.01 \leq C \leq 0.4$.

$2.5 \leq Si \leq 3.3$

Si is an element which is contained for the purpose of improving the hardness by forming silicides. The reason for the lower limit of Si content being 2.5% is that in the case where the Si content is less than 2.5%, the areal proportion of a Mo—Si alloy phase which will have a crystal structure of C15 type Laves phase in the alloy powder after performing sintering is too low and this results in a decrease in powder hardness. Meanwhile, the reason for the upper limit of the Si content being 3.3% is that in the case where the Si content exceeds 3.3%, the areal proportion of a Mo—Si alloy phase which will have a crystal structure of C15 type Laves phase is too high and this results in too high hardness of the powder and a low sintered density, thereby increasing the wear amount of the sintered body. A preferred range of the Si content is $2.7 \leq Si \leq 3.1$.

$0.1 \leq Ni \leq 20.0$

Ni is contained in an amount of 0.1% or larger from the standpoint of improving the toughness. However, since excessive addition of Ni leads to a deterioration of wear resistance due to decrease in heat resistance (melting point), the upper limit of the Ni content is 20.0%. A preferred range of the Ni content is $5.0 \leq Ni \leq 11.0$. A more preferred range thereof is $7.0 \leq Ni \leq 10.0$.

$5.0 \leq Cr \leq 15.0$

Cr is an element which is contained for the purpose of maintaining oxidation resistance and hardness. The reason for the lower limit of Cr content being 5.0% is that in the case where the Cr content is less than 5.0%, the wear resistance is deteriorated due to decreases in oxidation resistance and heat resistance. Meanwhile, the reason for the upper limit of the Cr content being 15.0% is that in the case where the Cr content exceeds 15.0%, decrease in sintered density due to decrease in moldability results in deterioration of wear resistance. A preferred range of the Cr content is $6.0 \leq Cr \leq 11.0$. A more preferred range thereof is $7.0 \leq Cr \leq 10.0$.

$35.0 \leq Mo \leq 45.0$

Mo is an element which is contained for the purpose of maintaining the hardness of the powder particles. The reason for the lower limit of Mo content being 35.0% is that in the case where the Mo content is less than 35.0%, the areal proportion of a Mo—Si alloy phase which will have a crystal structure of C15 type Laves phase in the alloy powder after performing sintering is too low and this results in decrease in powder hardness. Meanwhile, the reason for the upper limit of the Mo content being 45.0% is that in the case where the Mo content exceeds 45.0%, the areal proportion of an Mo—Si alloy phase which will have a crystal structure of C15 type Laves phase is too high and this results in too high hardness of the powder and a low sintered density, thereby increasing the wear amount of the sintered body. A preferred range of the Mo content is $38.0 \leq Mo \leq 42.0$. A more preferred range thereof is $39.0 \leq Mo \leq 41.0$.

In the hard particle powder for a sintered body of the present embodiment, the balance thereof, which is the portion other than the above-described additive elements, is Fe and inevitable impurities. Examples of impurity elements include oxygen (O), nitrogen (N), sulfur (S), phosphorus (P), copper (Cu), and manganese (Mn). Upper limits of these may be: $O \leq 0.30$, $N \leq 0.10$, $S \leq 0.02$, $P \leq 0.03$, $Cu \leq 0.2$, and $Mn \leq 0.3$.

(Method for Manufacturing Hard Particle Powder)

The hard particle powder of the present embodiment can be manufactured by powdering an alloy melt having a given chemical composition using, for example, an atomization method. According to need, the powdering may be followed by, for example, classifying the obtained alloy powder to regulate the particle sizes to appropriate sizes.

In the manufacturing method, the alloy melt can be obtained by weighing out raw materials so as to result in the given chemical composition and melting the weighed raw materials using a melting device such as an arc furnace, a high-frequency induction furnace, or a heating furnace.

Examples of methods for obtaining a powder from the alloy melt include atomization methods (gas atomization method, water atomization method, etc.). In the case of using a gas atomization method, the alloy melt is discharged into a spray chamber to cause the alloy melt to flow downward continuously (in the form of a rod) and a gas, such as $N_2$, Ar, or He, is blown against the melt at a high pressure (e.g., 1 MPa-10 MPa), thereby pulverizing and simultaneously cooling the melt. The cooled melt in a semi-molten state falls freely within the spray chamber and comes to have a shape close to sphere. Thus, a hard particle powder is obtained. From the standpoint of improving the cooling effect, high-pressure water may be jetted in place of the gas.

The shape of particles in the hard particle powder varies depending on atomization conditions, etc. The shape of particles in the powder affects the fillability into molds and the density of sintered bodies.

The particles in the hard particle powder desirably has a particle diameter (average particle size (D50)) in the range of from 30 μm to 80 μm. D50 means volume-based average particle size, and can be determined using a laser diffraction/scattering type particle size distribution analyzer, etc.

In the present embodiment, the circularity of particles in the hard particle powder is desirably specified so as to be within a given range. The circularity is defined as $4\pi S/L^2$, where S is the projected area of a particle and L is the circumference thereof. The circularity of a particle having the shape of a complete circle is 1; the more the shape becomes complicated, the more the circularity decreased from 1. The particles in the hard particle powder of the present embodiment, which have a high hardness, hardly deform and in the case where particles in the powder are excessively noncircular, it is difficult to obtain a sintered body having an increased density. Consequently, it is desirable that in the powder, an average circularity of particles having a particle size in the range of D50(average particle size)±5 μm is in the range of from 0.6 to 1.0.

In the thus-obtained hard particle powder for sintered bodies, which has the given chemical composition, an alloy phase having a hexagonal crystal structure of C14 type Laves phase and containing Mo and Si in large amounts is present as a main phase.

2. Sintered Body

A sintered body including the hard particle powder according to the present embodiment can be manufactured through the mixing step, molding step, and sintering step described below.

In the mixing step, the hard particle powder, which has the component composition described above, is mixed with a pure iron powder and a graphite powder to obtain a mixed powder. The amounts of these ingredients to be blended can be selected so as to be optimal in accordance with purposes.

In case where the blending amount of the hard particle powder is too small, the sintered body has reduced wear resistance. Consequently, the blending amount of the hard particle powder is preferably 5.0 mass % or larger, more preferably 10.0 mass % or larger. Meanwhile, in case where the blending amount of the hard particle powder is too large, the mixed powder has reduced sintering characteristics. Consequently, the blending amount of the hard particle powder is preferably 50.0 mass % or less, more preferably 35.0 mass % or less.

On the other hand, in case where the blending amount of the graphite powder is too small, the sintered body has reduced wear resistance. Consequently, the blending amount of the graphite powder is preferably 0.5 mass % or larger, more preferably 0.8 mass % or larger. On the other hand, in case where the blending amount of the graphite powder is too large, the mixed powder has reduced sintering characteristics. Consequently, the blending amount of the graphite powder is preferably 2.0 mass % or less, more preferably 1.5 mass % or less.

In the mixing step, materials other than the hard particle powder, pure iron powder, and graphite powder can be added according to need. For example, a molding lubricant for improving moldability can be added.

Next, in the molding step, the mixed powder is compacted and molded, thereby obtaining a compact body. Compacting and molding conditions are not particularly limited, and optimal conditions can be selected in accordance with purposes. In general, the higher the molding pressure, the more the molding density is improved. The compact body obtained in the molding step is desirably dewaxed before performing sintering.

Next, in the sintering step, the compact body is sintered. It is preferred to select optimal sintering conditions in accordance with the composition of the compact body. In general, the higher the sintering temperature, the shorter the heat treatment period necessary for obtaining a dense sintered body. Meanwhile, too high sintering temperatures pose a problem in that the hard particles either diffuse excessively into the iron-based matrix or melt. Although optimal sintering conditions vary depending on the composition of the compact body, generally, the sintering is preferably performed at from 1,100° C. to 1,300° C. for from 0.5 hours to 3 hours. It is also preferred to perform sintering in a reducing atmosphere (e.g., in an atmosphere of resolved ammonia).

In the sintered body obtained through the sintering step, the alloy phase having a hexagonal crystal structure of C14 type Laves phase, which was present in the hard particle powder before performing sintering, transforms into an alloy phase (Mo—Si hard phase) having a face-centered cubic crystal structure of C15 type, which has a higher hardness. In the sintered body according to the present embodiment, the Laves phase (face-centered cubic crystal structure of C15 type) is present in an areal proportion of from 60 to 85% in the hard particle powder to a total sectional area of the hard particle powder after performing sintering, thereby contributing to enhancing the wear resistance of the sintered body.

EXAMPLES

Examples of the present invention are described below.

(Production of Hard Particle Powders)

Raw materials were weighed out so as to result in each of the alloy compositions shown in Tables 1 and 2. In each of the Comparative Examples shown in Table 2, the content of at least one element is outside the range specified in the present invention. Comparative Example 1 is the composition of a conventional Co-based alloy powder (bench mark material) containing Co.

The weighed raw materials were heated and melted using a high-frequency induction furnace to obtain an alloy melt. From each alloy melt obtained, a hard particle powder was obtained by an atomization method. In Examples 1 to 25 and Comparative Examples 1 to 9, the hard particle powders were produced by a water atomization method. In Example 26, the hard particle powder was produced by a gas atomization method.

TABLE 1

| | | Chemical composition (mass %) | | | | | | | Areal proportion of C15 type | Hardness of hard particle powder (Hv) | | | |
|---|---|---|---|---|---|---|---|---|---|---|---|---|---|
| | | C | Si | Ni | Cr | Mo | Fe | Co | Laves phase (%) | Before performing sintering | After performing sintering | Wear amount (μm) | Sintered density (g/cm³) |
| Ex. | 1 | 0.01 | 2.8 | 10 | 8 | 40 | Bal. | — | 80 | 932 | 1077 | 17 | 7.18 |
| | 2 | 0.1 | 2.8 | 10 | 8 | 40 | Bal. | — | 80 | 933 | 1081 | 16 | 7.15 |
| | 3 | 0.3 | 2.8 | 10 | 8 | 40 | Bal. | — | 79 | 934 | 1083 | 16 | 7.11 |
| | 4 | 0.5 | 2.8 | 10 | 8 | 40 | Bal. | — | 79 | 936 | 1090 | 15 | 7.08 |
| | 5 | 0.8 | 2.8 | 10 | 8 | 40 | Bal. | — | 77 | 940 | 1093 | 15 | 7.06 |
| | 6 | 1.0 | 2.8 | 10 | 8 | 40 | Bal. | — | 75 | 987 | 1112 | 16 | 7.01 |
| | 7 | 0.3 | 2.6 | 10 | 8 | 40 | Bal. | — | 62 | 918 | 1044 | 19 | 7.18 |
| | 8 | 0.3 | 3.0 | 10 | 8 | 40 | Bal. | — | 81 | 945 | 1115 | 16 | 7.09 |
| | 9 | 0.3 | 3.2 | 10 | 8 | 40 | Bal. | — | 82 | 970 | 1145 | 16 | 7.04 |
| | 10 | 0.3 | 3.3 | 10 | 8 | 40 | Bal. | — | 85 | 991 | 1163 | 19 | 7.00 |
| | 11 | 0.3 | 2.8 | 0.1 | 8 | 40 | Bal. | — | 70 | 940 | 1281 | 18 | 7.13 |
| | 12 | 0.3 | 2.8 | 1 | 8 | 40 | Bal. | — | 73 | 940 | 1230 | 17 | 7.14 |
| | 13 | 0.3 | 2.8 | 3 | 8 | 40 | Bal. | — | 75 | 939 | 1184 | 16 | 7.15 |
| | 14 | 0.3 | 2.8 | 5 | 8 | 40 | Bal. | — | 76 | 937 | 1145 | 16 | 7.17 |
| | 15 | 0.3 | 2.8 | 8 | 8 | 40 | Bal. | — | 78 | 934 | 1102 | 17 | 7.18 |
| | 16 | 0.3 | 2.8 | 15 | 8 | 40 | Bal. | — | 81 | 920 | 1056 | 17 | 7.18 |
| | 17 | 0.3 | 2.8 | 20 | 8 | 40 | Bal. | — | 78 | 918 | 1032 | 18 | 7.19 |
| | 18 | 0.3 | 2.8 | 10 | 5 | 40 | Bal. | — | 79 | 921 | 1043 | 18 | 7.14 |
| | 19 | 0.3 | 2.8 | 10 | 10 | 40 | Bal. | — | 80 | 936 | 1091 | 15 | 7.10 |
| | 20 | 0.3 | 2.8 | 10 | 12 | 40 | Bal. | — | 81 | 947 | 1111 | 14 | 7.08 |
| | 21 | 0.3 | 2.8 | 10 | 15 | 40 | Bal. | — | 82 | 969 | 1132 | 12 | 7.06 |
| | 22 | 0.3 | 2.8 | 10 | 8 | 35 | Bal. | — | 62 | 867 | 1040 | 19 | 7.14 |
| | 23 | 0.3 | 2.8 | 10 | 8 | 37 | Bal. | — | 70 | 894 | 1052 | 17 | 7.12 |
| | 24 | 0.3 | 2.8 | 10 | 8 | 43 | Bal. | — | 81 | 962 | 1100 | 15 | 7.07 |
| | 25 | 0.3 | 2.8 | 10 | 8 | 45 | Bal. | — | 83 | 991 | 1131 | 14 | 7.01 |
| | 26 | 0.3 | 2.8 | 10 | 8 | 40 | Bal. | — | 74 | 876 | 1049 | 16 | 7.32 |

TABLE 2

| | | Chemical composition (mass %) | | | | | | | Areal proportion of C15 type | Hardness of hard particle powder (Hv) | | | |
|---|---|---|---|---|---|---|---|---|---|---|---|---|---|
| | | C | Si | Ni | Cr | Mo | Fe | Co | Laves phase (%) | Before performing sintering | After performing sintering | Wear amount (μm) | Sintered density (g/cm³) |
| Comp. | 1 | 0.01 | 2.0 | 10 | 25 | 25 | ≤5 | Bal. | 33 | 901 | 944 | 25 | 7.18 |
| Ex. | 2 | 1.5 | 2.8 | 10 | 8 | 40 | Bal. | — | 72 | 1028 | 1201 | 31 | 6.83 |
| | 3 | 0.3 | 2.2 | 10 | 8 | 40 | Bal. | — | 28 | 741 | 807 | 45 | 7.13 |
| | 4 | 0.3 | 3.7 | 10 | 8 | 40 | Bal. | — | 87 | 1053 | 1209 | 53 | 6.81 |
| | 5 | 0.3 | 2.8 | 25 | 8 | 40 | Bal. | — | 58 | 775 | 911 | 47 | 7.21 |
| | 6 | 0.3 | 2.8 | 10 | 3 | 40 | Bal. | — | 56 | 758 | 895 | 53 | 7.18 |
| | 7 | 0.3 | 2.8 | 10 | 20 | 40 | Bal. | — | 72 | 1082 | 1189 | 39 | 6.75 |
| | 8 | 0.3 | 2.8 | 10 | 8 | 30 | Bal. | — | 41 | 742 | 797 | 42 | 7.22 |
| | 9 | 0.3 | 2.8 | 10 | 8 | 50 | Bal. | — | 89 | 1054 | 1293 | 51 | 6.78 |

(Evaluation of Properties of the Hard Particle Powders)

The produced hard particle powders were evaluated for property. Specifically, the powders of Examples 1 and 11 and Comparative Example 1 were evaluated for particle size distribution, apparent density, and flow rate. The powders of all the Examples and Comparative Examples were evaluated for the hardness of the hard particle powder before and after performing sintering.

The particle size distribution was determined in accordance with Japanese Industrial Standards JIS Z 2510-2004. The apparent density was measured in accordance with Japanese Industrial Standards JIS Z 2504-2012 and the flow rate was measured in accordance with Japanese Industrial Standards JIS Z 2502-2012. The hardness of the hard particle powder was determined with a microhardness measurement instrument, by measuring the hardness thereof in terms of Vickers hardness under a load of 50 g.

The results of the measurements of particle size distribution, apparent density, and flow rate are shown in Table 3, and the results of the measurement of the hardness of the hard particle powder are shown in Tables 1 and 2.

TABLE 3

| | Particle size distribution (mesh, mass %) | | | | | | | Powder characteristics | |
|---|---|---|---|---|---|---|---|---|---|
| | +80 | −80/+100 | −100/+145 | −145/+200 | −200/+250 | −250/+350 | −350 | Apparent density (g/cm$^3$) | Flow rate (s/50 g) |
| Ex. 1 | 0.0 | 0.1 | 12.1 | 21.3 | 11.4 | 19.4 | 35.7 | 3.32 | 21.2 |
| Ex. 11 | 0.1 | 0.2 | 12.1 | 19.1 | 12.7 | 17.7 | 38.1 | 3.47 | 18.8 |
| Com. Ex. 1 | 0.0 | 0.1 | 9.6 | 17.6 | 13.3 | 20.6 | 38.8 | 3.37 | 19.4 |

(Evaluation of Shape of the Particles in the Hard Particle Powders)

Figure 6:
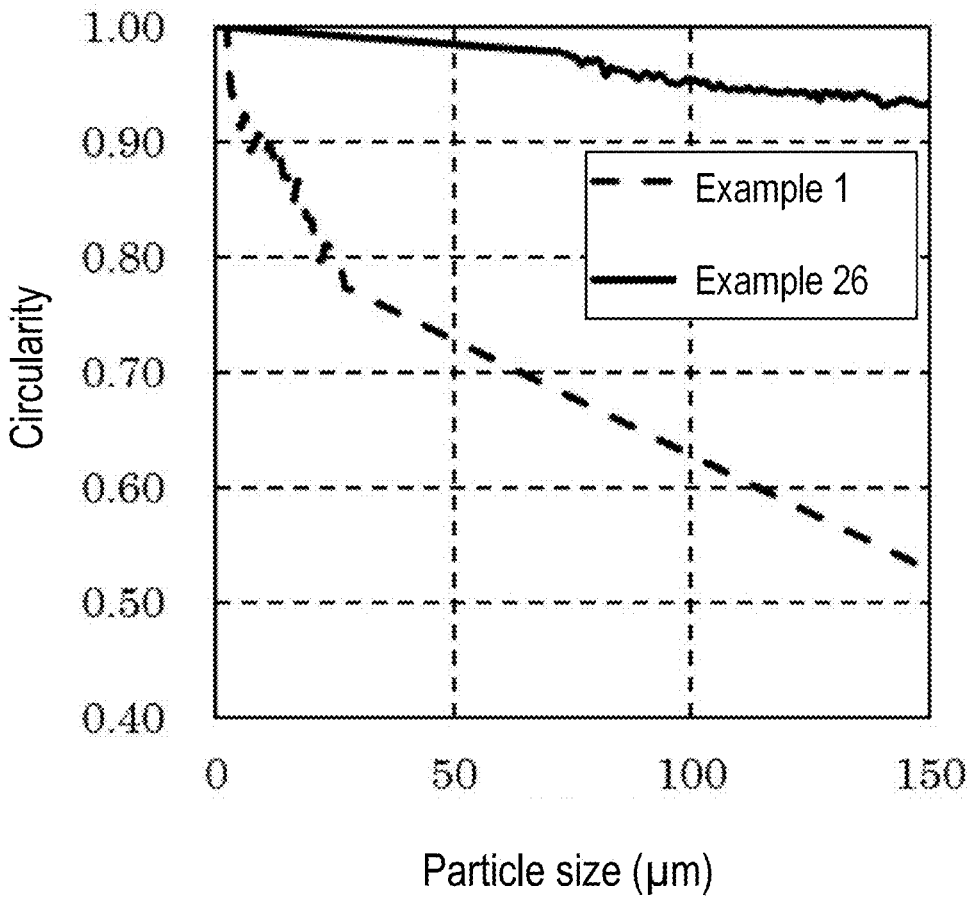
FIG. 6 is a diagram showing relationships between particle size and circularity of particles in hard particle powders according to Examples 1 and 26.
Figure 7A:
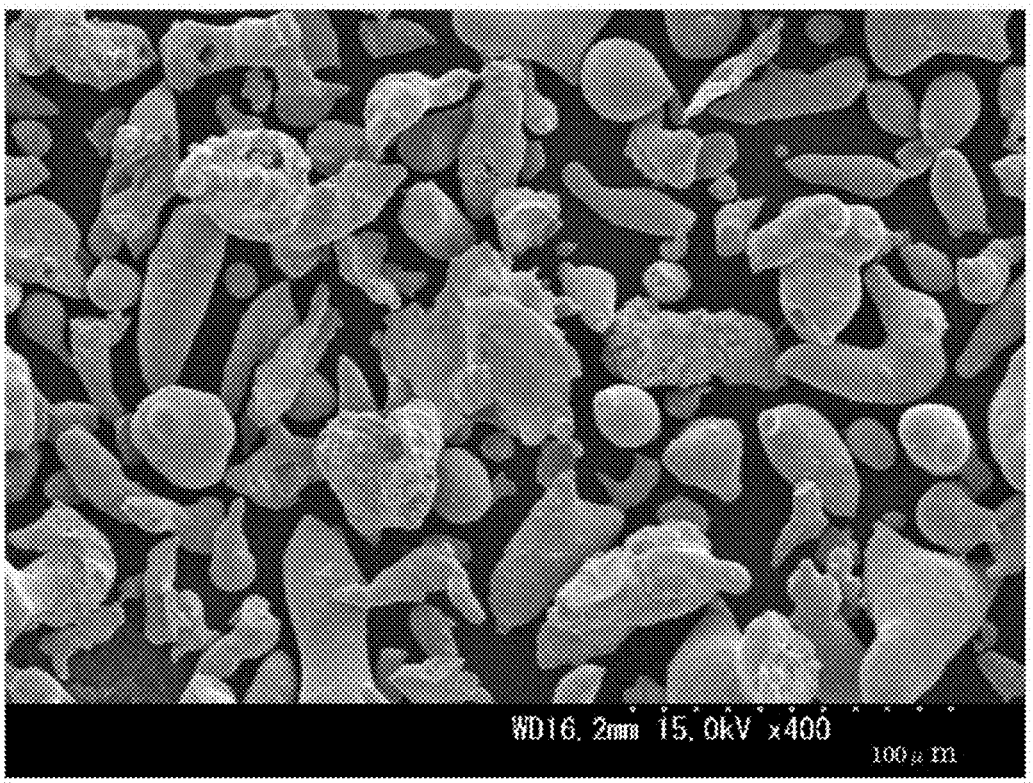
FIG. 7A is a scanning electron microscope photograph of hard particle powder before performing sintering according to Example 1.
Figure 7B:
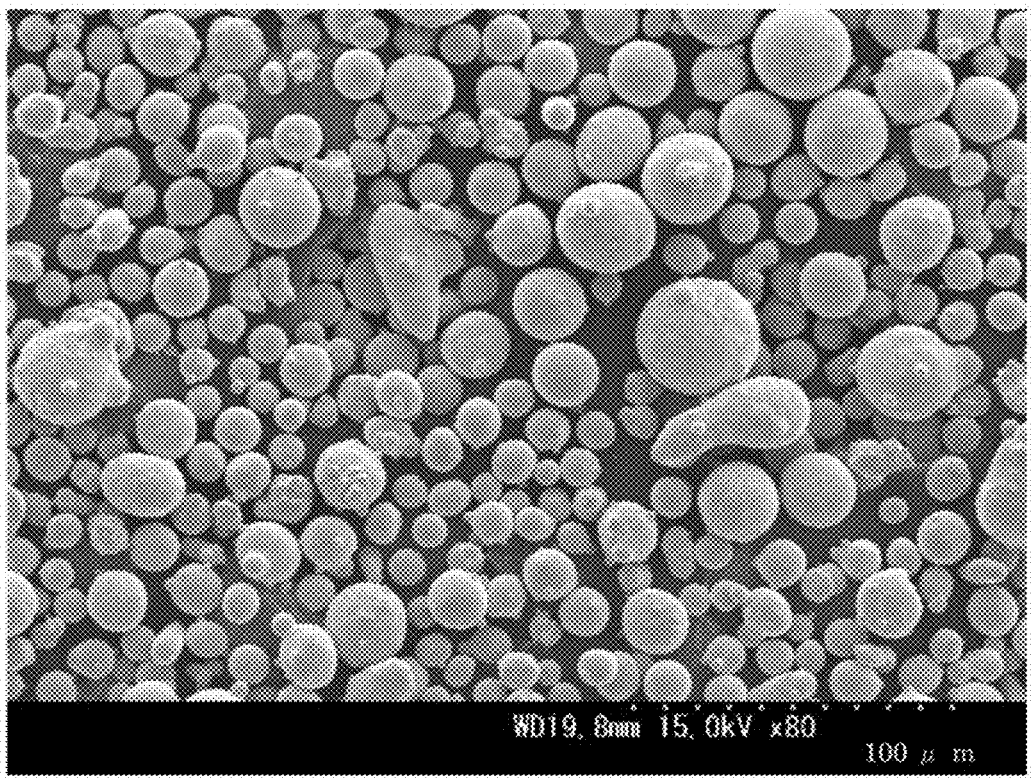
FIG. 7B is a scanning electron microscope photograph of hard particle powder before performing sintering according to Example 26.

The obtained hard particle powders were evaluated for shape (circularity) of the particles. Using a powder shape analyzer (CAMSIZER X-2, manufactured by Verder Scientific GmbH), each powder was jetted and allowed to fall in a dry atmosphere and was photographed with a high-speed camera, and image processing was conducted to determine the circularity of the particles in the powder. In FIG. 6 are shown the results (relationship between particle size and circularity) of the examination of particles in the powder of Example 1 (produced by water atomization method) and the particles in the powder of Example 26 (produced by gas atomization method). FIG. 7A is a scanning electron microscope photograph of hard particle powder before performing sintering according to Example 1. FIG. 7B is a scanning electron microscope photograph of hard particle powder before performing sintering according to Example 26.

In Table 4 are shown the average particle size and circularity of the particles in each of the hard particle powders of Examples 1, 11, and 26 and Comparative Example 1. The "circularity" indicates an average of eleven circularity values of particles having a particle size of in the range of D50(average particle size)±5 μm.

TABLE 4

| | Average particle size D50 (μm) | Average of Circularity (—) |
|---|---|---|
| Ex. 1 | 66.1 | 0.70 |
| Ex. 11 | 72.2 | 0.60 |
| Ex. 26 | 39.4 | 0.99 |
| Comparative Ex. 1 | 65.9 | 0.72 |

(Production of Sintered Bodies)

Using the hard particle powders of Examples 1 to 26 and Comparative Examples 1 to 9, sintered bodies were produced in the following manner.

First, 69.2 mass % of pure iron powder (ASC100.29), 30 mass % of each hard particle powder, and 0.8 mass % of graphite (CPB) were mixed together. Furthermore, 0.5 parts by weight of Zn-St (molding lubricant) was added to and mixed with 100 parts by weight of the mixture to obtain a raw-material mixed powder for sintered bodies.

Subsequently, the raw-material mixed powders of Examples 1 to 26 and Comparative Examples 1 to 9 were compacted and molded at a molding pressure of 8 t/cm$^2$ to obtain disc-shaped compact bodies having a diameter of 35 mm and a thickness of 14 mm. Next, the disc-shaped compact bodies were dewaxed for 1 hour in the air having a temperature of 400° C. and then performed sintering in a 1,160° C. atmosphere of resolved ammonia ($N_2$+3$H_2$) for 1 hour, thereby obtaining sintered bodies.

(Evaluation of Sintering Characteristics)

The produced sintered bodies were examined for sintered density (density of the sintered body obtained thorough sintering) in accordance with Japanese Industrial Standards JIS Z 2509-2004. The results thereof are shown in Tables 1 and 2.

(Structure Examination of the Sintered Bodies and Determination of Areal Proportion)

The hard particle powders before performing sintering, and the hard particle powders which are included in the sintered bodies obtained through sintering were examined with a scanning electron microscope (SEM) for structure and were analyzed by X-ray diffractometry.

Figure 3:
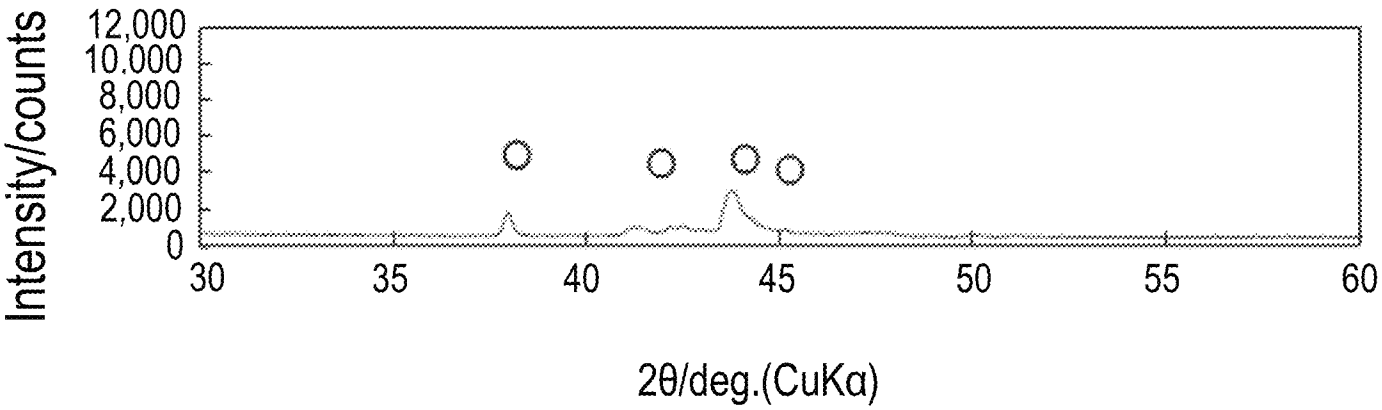
FIG. 3 is a diagram showing an X-ray diffraction data pattern of the hard particle powder before performing sintering according to Example 1.

With respect to the hard particle powders before performing sintering, it was ascertained that each powder contained an alloy phase having a hexagonal crystal structure of C14 type Laves phase. In FIG. 3 is shown an X-ray diffraction data pattern of the hard particle powder of Example 1 as a representative example of the hard particle powders before performing sintering.

Figure 4A:
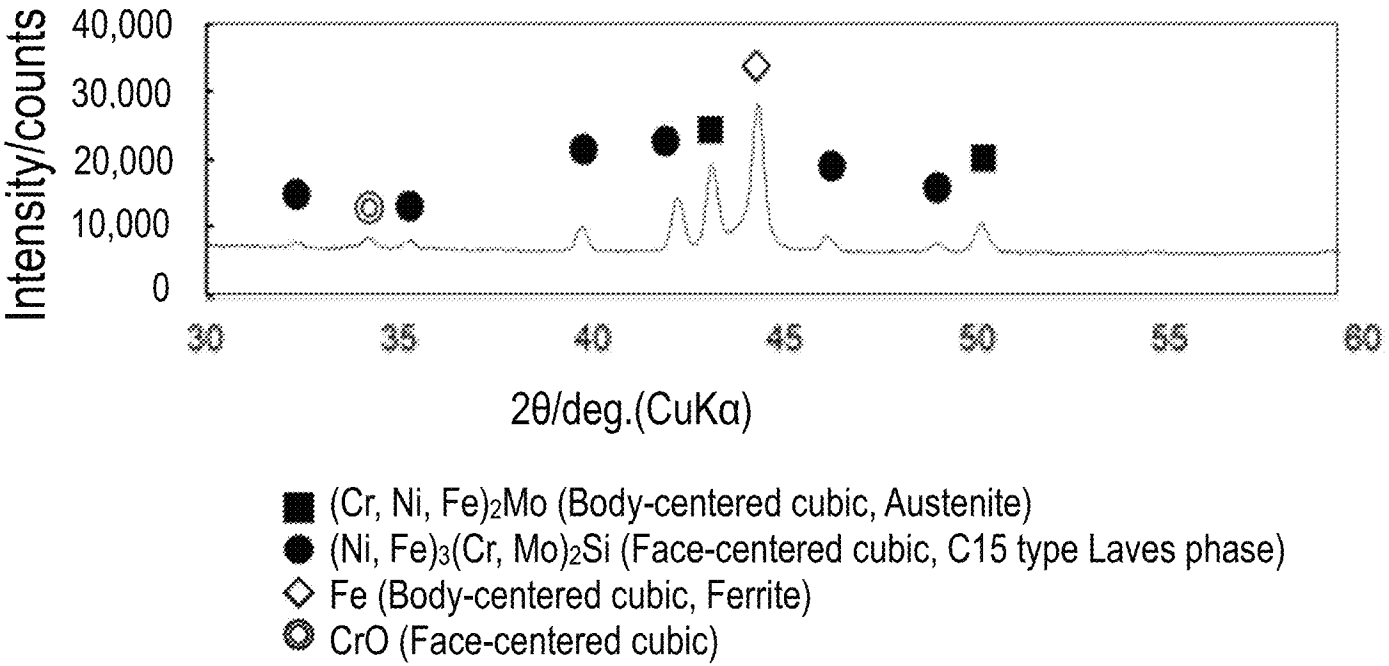
FIG. 4A is a diagram showing X-ray diffraction data pattern of sintered bodies according to Example 1.
Figure 4B:
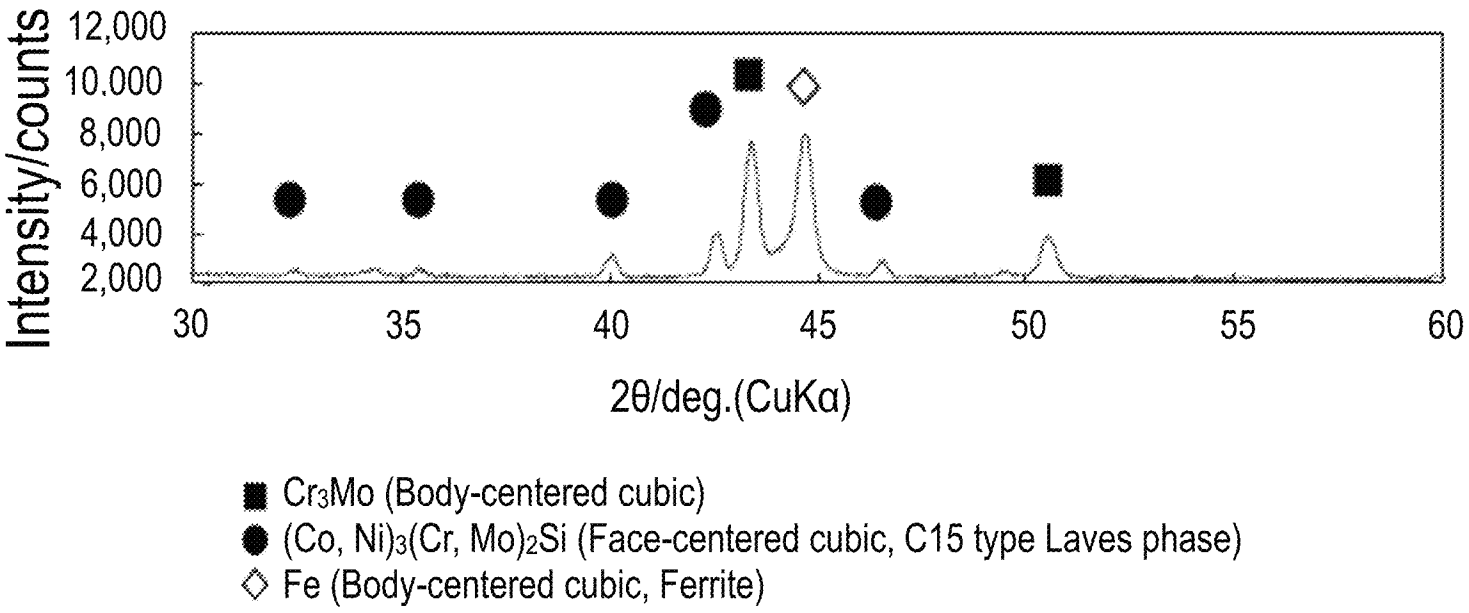
FIG. 4B is a diagram showing X-ray diffraction data pattern of sintered bodies according to Comparative Example 1.
Figure 4C:
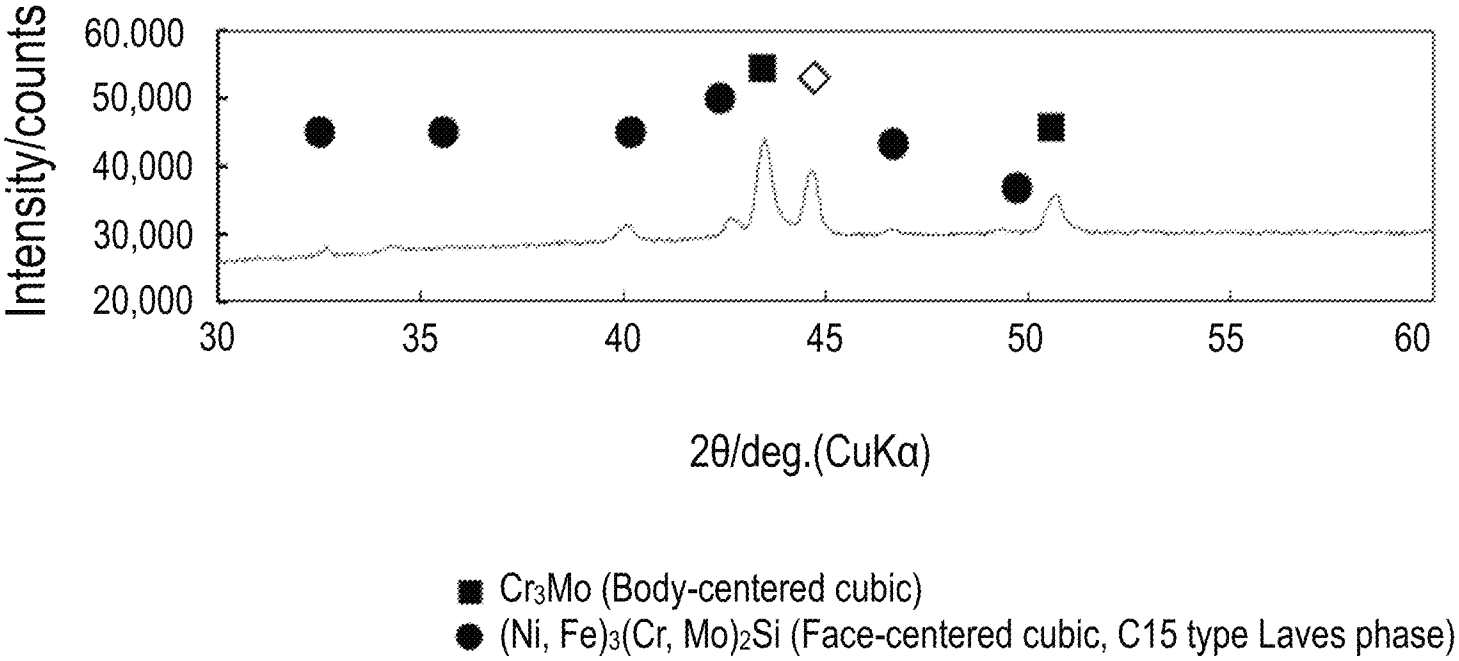
FIG. 4C is a diagram showing X-ray diffraction data pattern of sintered bodies according to Comparative Example 8.

Next, with respect to the hard particle powders contained in the sintered bodies obtained through sintering, it was ascertained that each powder contained a Mo—Si hard phase having a face-centered cubic crystal structure of C15 type Laves phase. In FIGS. 4A to 4C are shown X-ray diffraction data patterns of the sintered bodied of Example 1, Comparative Example 1, and Comparative Example 8 as representative examples.

Figure 5A:
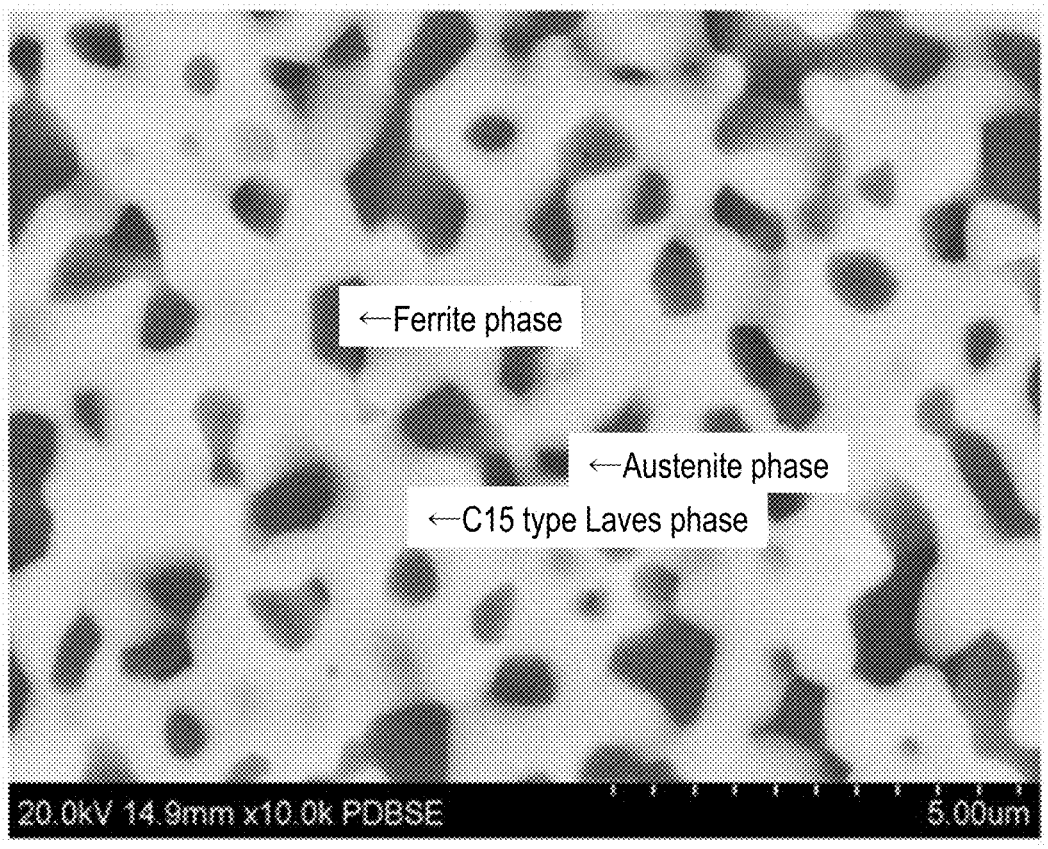
FIG. 5A is a scanning electron microscope photograph of section of hard particle powder after performing sintering according to Example 1.
Figure 5B:
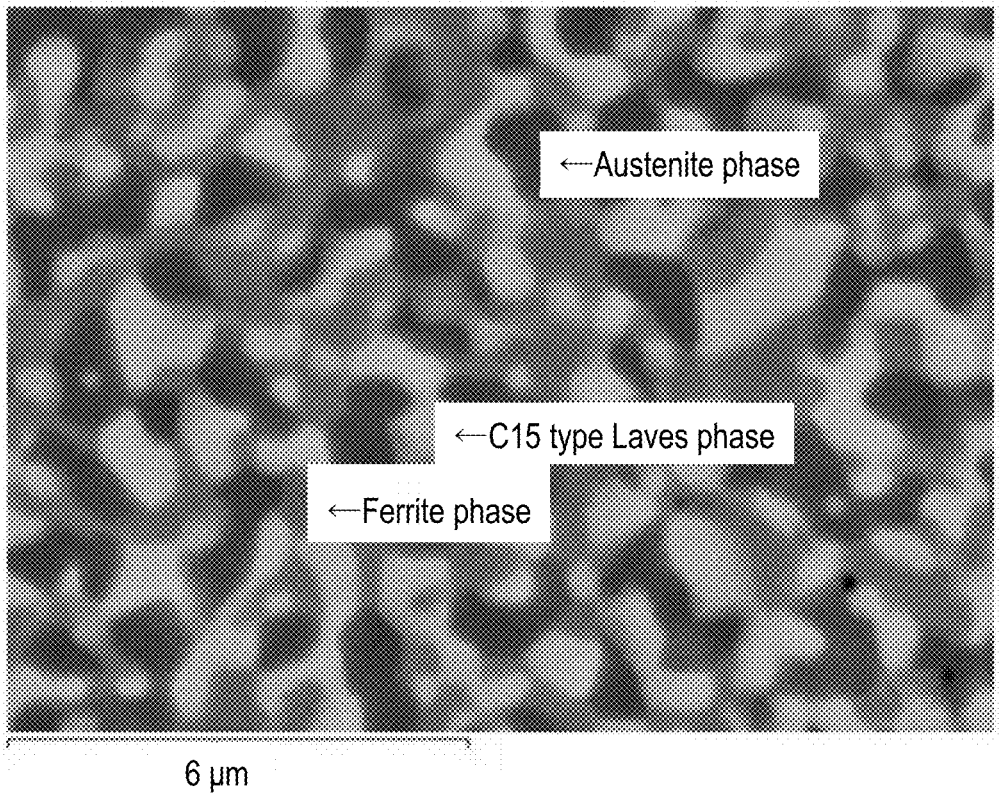
FIG. 5B is a scanning electron microscope photograph of section of hard particle powder after performing sintering according to Comparative Example 1.
Figure 5C:
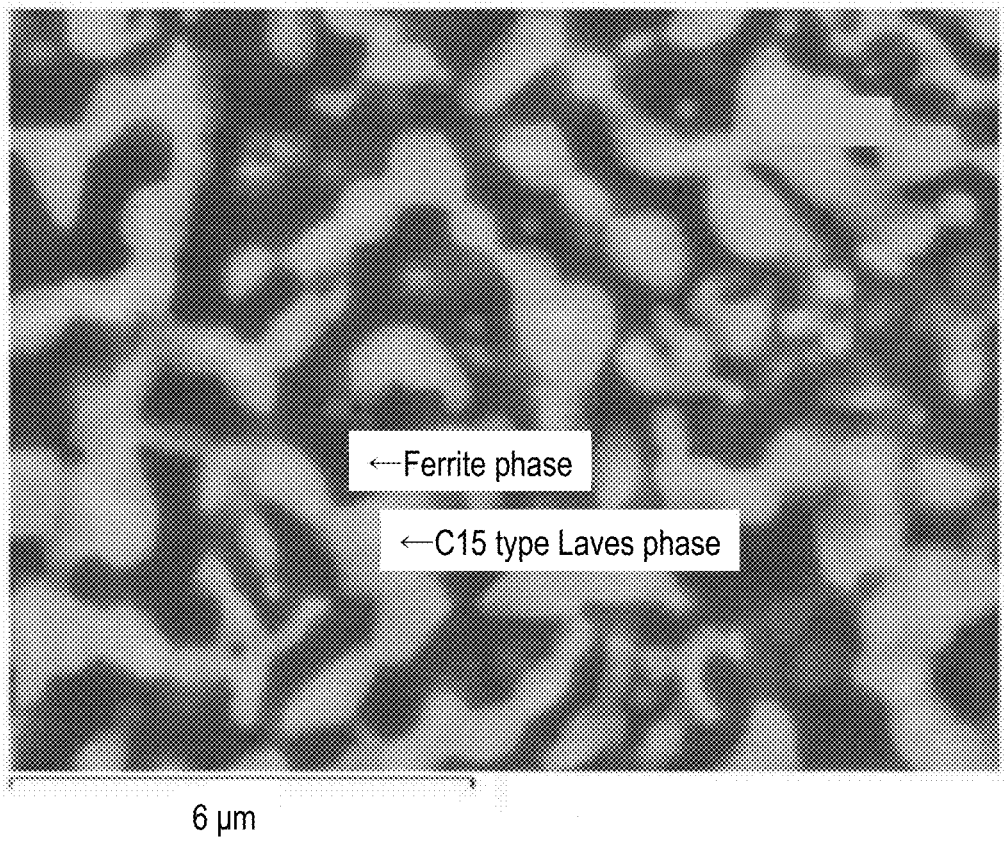
FIG. 5C is a scanning electron microscope photograph of section of hard particle powder after performing sintering according to Comparative Example 8.

Furthermore, the areal proportion of the Mo—Si hard phase in each hard particle powder was calculated from an SEM image (see FIGS. 5A to 5C) of a section of the powder. Specifically, using image processing software WinROOF, the areal proportion of the Mo—Si hard phase was calculated from color-density differences in the SEM image. In FIGS. 5A to 5C, the portions which look white are the Mo—Si hard phase. It can be seen that in the sintered bodies shown in FIGS. 5A to 5C, the areal proportion of the Mo—Si hard phase increased in the order of: Comparative Example 1 in FIG. 5B<Comparative Example 8 in FIG. 5C<Example 1 in FIG. 5A. With respect to each of the sintered bodies of the Examples and Comparative Examples, areal proportions were calculated using three different fields of view and an average of these is shown as the areal proportion in Tables 1 and 2.

(Wear Resistance Test of the Sintered Bodies)

Using the single rig wear testing machine (hereinafter referred to simply as "wear tester") shown in FIG. 1, a wear resistance test of the sintered bodies (disc-shaped sintered bodies produced) was conducted. First, each of the disc-shaped sintered bodies (having a diameter of 35 mm and a thickness of 14 mm) was worked to a valve-seat shape and used as individual test specimen. Each wear test specimen was set in the wear tester by being pressed into the sheet holder. The wear tester was driven under the testing conditions shown in Table 5. The wear test specimen was worn by a tapping that was input by crank driving while indirectly heating the wear test specimen by heating the valve with a gas flame.

TABLE 5

| | |
|---|---|
| Testing time | 10 hours |
| Fuel | LPG |
| Contact rate | 3,000 times per minute |
| Wear test specimen temperature | 300° C. |
| Valve driving | Crank shaft |
| Valve rotation rate | 10 times per minute |
| Valve face | Fe—21Cr—9Mn—4Ni—Co alloy Welding |

Figure 2:
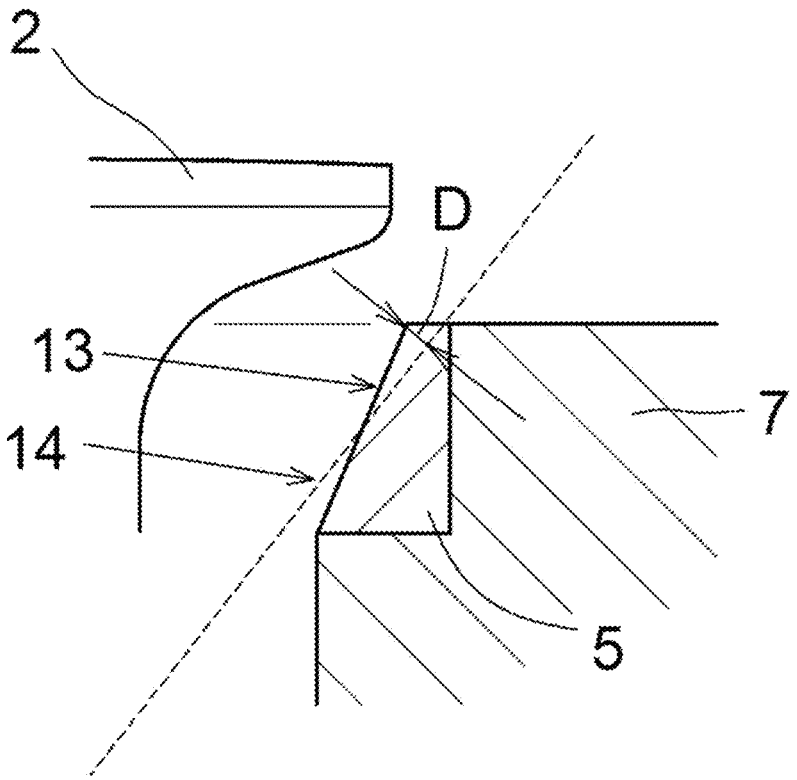
FIG. 2 is a view for describing a measurement place of a wear amount of a wear test specimen.

A wear amount of each wear test specimen was obtained by determining the shapes of the wear test specimen of before and after the wear test with a shape measurement instrument and determining the difference D along a direction perpendicular to a surface of the wear test specimen as shown in FIG. 2 (enlarged view of the portion of FIG. 1 indicated by the arrow A). The results thereof are shown in Tables 1 and 2.

The following can be seen from the thus-obtained results of the examinations.

(With respect to Wear Resistance)

As Table 1 shows, Examples 1 to 26 each had a wear amount of less than 25 μm, whereas Comparative Examples 1 to 9 each had a wear amount of 25 μm or larger. That is, Examples 1 to 26 had smaller wear amounts than Comparative Examples 1 to 9.

A comparison between Examples 1 to 26 and Comparative Examples 1 to 9 shows the following. These powders each satisfied the preferred requirements according to the present embodiment, except for the component ranges. Consequently, the component compositions of Examples 1 to 26 had an effect on improving the wear resistance of sintered bodies (valve seats).

From the standpoint of crystal structure, the effect on improving the wear resistance of sintered bodies (valve seats) was produced in the case where the content (areal proportion) of an alloy phase of C15 type Laves phase (face-centered cubic crystal structure) in the hard particle powder after performing sintering was in the range of from 60 to 85% as in Examples 1 to 26. Meanwhile, it can be seen, as in Comparative Examples 1, 3 to 6, 8 and 9, that the effect on improving the wear resistance was not obtained in the case where the content of an alloy phase of C15 type Laves phase was less than 60% or was higher than 85%.

A close examination of the Comparative Examples given in Table 2 reveals the following. Comparative Example 1, which is a conventional material, had an excellent wear amount of 25 μm. However, the cost of this material is undesirably prone to be affected by an increase in the cost of Co sources, because of the too high Co content.

The reason why Comparative Example 2 had a large wear amount is thought to be because the powder had too high a C content and hence too high a hardness and poor moldability and this resulted in a low sintered density.

The reason why Comparative Example 3 had a large wear amount is thought to be because the powder had too low an Si content and the hard particle powder after performing sintering hence had a low areal proportion of an alloy phase of C15 type Laves phase and had a reduced powder hardness.

The reason why Comparative Example 4 had a large wear amount is thought to be because the powder had too high an Si content and the hard particle powder after performing sintering hence had too high an areal proportion of an alloy phase of C15 type Laves phase and too high a hardness and hence had poor moldability and this resulted in a low sintered density.

The reason why Comparative Example 5 had a large wear amount is thought to be because the powder had too high an Ni content and a reduced powder hardness.

The reason why Comparative Example 6 had a large wear amount is thought to be because the powder had too low a Cr content and a reduced powder hardness.

The reason why Comparative Example 7 had a large wear amount is thought to be because the powder had too high a Cr content and hence had too high a hardness and poor moldability, resulting in a low sintered density.

The reason why Comparative Example 8 had a large wear amount is thought to be because the powder had too low a Mo content and the hard particle powder after performing sintering hence had too low an areal proportion of an alloy phase of C15 type Laves phase and had a reduced powder hardness.

The reason why Comparative Example 9 had a large wear amount is thought to be because the powder had too high a Mo content and the hard particle powder after performing sintering hence had too high an areal proportion of an alloy phase of C15 type Laves phase and too high a hardness and hence had poor moldability, resulting in a low sintered density.

(With Respect to Properties Other than Wear Resistance)

A comparison among the particle size distributions and powder characteristics shown in Table 3 indicates that the particle size distributions and powder characteristics of Example 1 and Example 11 were deemed to be comparable to the particle size distribution and powder characteristics of Comparative Example 1. The differences in particle size distribution were little and were due to unevenness during powder production, and do not lessen the properties of Examples 1 and 11.

Furthermore, a comparison among the sintered densities shown as sintering characteristics in Tables 1 and 2 shows that the sintered densities of the Examples were on substantially the same level as the sintered density of Comparative Example 1 and there was no large difference which might affect the wear resistance.

It was seen from those results that the hard particle powders of the Examples, which each included a given component, were able to improve the wear resistance of sintered bodies (valve seats) while retaining substantially the powder characteristics and sintering characteristics and that the hard particle powders gave sintered bodies having excellent wear resistance.

While the invention has been described in detail, the invention is not limited to the embodiments and the Examples, and various modifications can be made therein without departing from the spirit thereof. For example, although valve seats were investigated in the Examples given above as a use of the hard particle powder of the present invention, the hard particle powder of the present invention can be used as machine components other than valve seats.

The present application is based on Japanese Patent Application No. 2021-119670 filed on Jul. 20, 2021, and the contents thereof are incorporated herein by reference.

1 GAS BURNER

2 VALVE

3 FLAME
4 WEAR TEST SPECIMEN (VALVE SEAT)
5 WEAR TEST SPECIMEN (VALVE SEAT)
6 SHEET HOLDER
7 SHEET HOLDER
8 COOLING WATER
9 VALVE GUIDE
10 SPRING
11 RETAINER CAP
12 LIFT BAR
13 BEFORE TESTING
14 AFTER TESTING

What is claimed is:

1. A particle powder for a sintered body, the powder consisting of, in terms of mass %, $0.01 \leq C \leq 1.0$,
$2.5 \leq Si \leq 3.3$,
$0.1 \leq Ni \leq 20.0$,
$5.0 \leq Cr \leq 15.0$, and
$35.0 \leq Mo \leq 45.0$, with the balance being Fe and inevitable impurities, wherein the powder before performing sintering comprises an alloy phase comprising a hexagonal crystal structure of C14 type Laves phase.

2. The particle powder for a sintered body according to claim 1, wherein in the powder, an average circularity of particles having a particle size in a range of D50±5 μm is from 0.6 to 1.0.

3. The particle powder for a sintered body according to claim 1, wherein in the powder after performing sintering, an areal proportion of a Mo—Si hard phase having a face-centered cubic crystal structure of C15 type Laves phase is from 60 to 85% to a total sectional area of the hard particle powder after performing sintering.

4. The particle powder for a sintered body according to claim 2, wherein in the powder after performing sintering, an areal proportion of a Mo—Si hard phase having a face-centered cubic crystal structure of C15 type Laves phase is from 60 to 85% to a total sectional area of the hard particle powder after performing sintering.

* * * * *